US005465965A

United States Patent [19]

Wurz

[11] Patent Number: 5,465,965

[45] Date of Patent: Nov. 14, 1995

[54] ROTATING PINBALL BRIDGE AND DROP

[75] Inventor: Norman R. Wurz, Chicago, Ill.

[73] Assignee: Sega Pinball, Inc., Melrose Park, Ill.

[21] Appl. No.: 214,456

[22] Filed: Mar. 18, 1994

[51] Int. Cl.[6] ..... A63F 7/30

[52] U.S. Cl. ..... 273/121 A; 273/121 R; 273/121 E; 273/118 K; 273/129 V

[58] Field of Search ..... 273/118 R, 118 A, 273/119 R, 119 A, 121 R, 121 A, 127 R, 127 D

[56] References Cited

U.S. PATENT DOCUMENTS 3,760,816 9/1973 Wochnowski ..... 131/140 R 5,356,142 10/1994 Borg et al. ..... 273/121 A

*Primary Examiner*—V. Millin

*Assistant Examiner*—Charles W. Anderson

*Attorney, Agent, or Firm*—Gerstman, Ellis & McMillin, Ltd.

[57] ABSTRACT

A rotating pinball bridge and drop is provided which comprises a rotatable cylinder with a hole sufficiently sized to allow a pinball to pass through. The cylinder is rotated by a drive member so that a ball may either pass through or be dropped from the ramp.

7 Claims, 1 Drawing Sheet

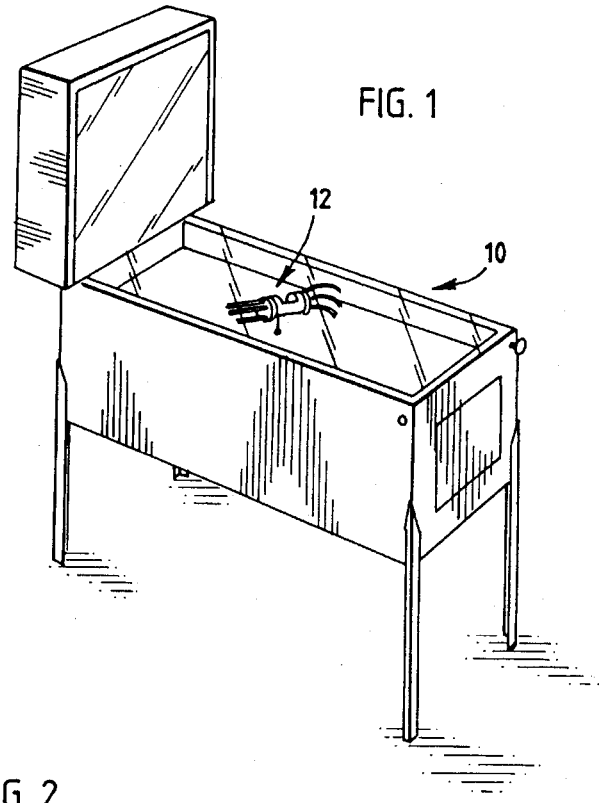
FIG. 1
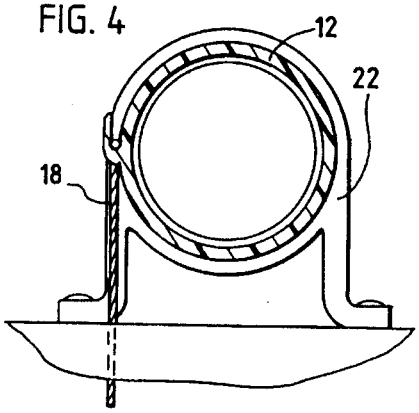
FIG. 4
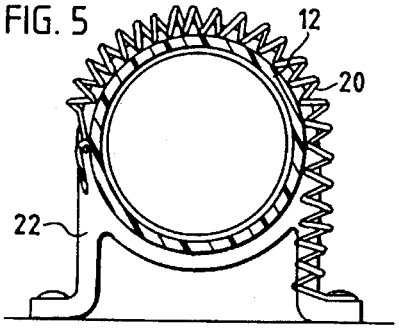
FIG. 5
FIG. 2
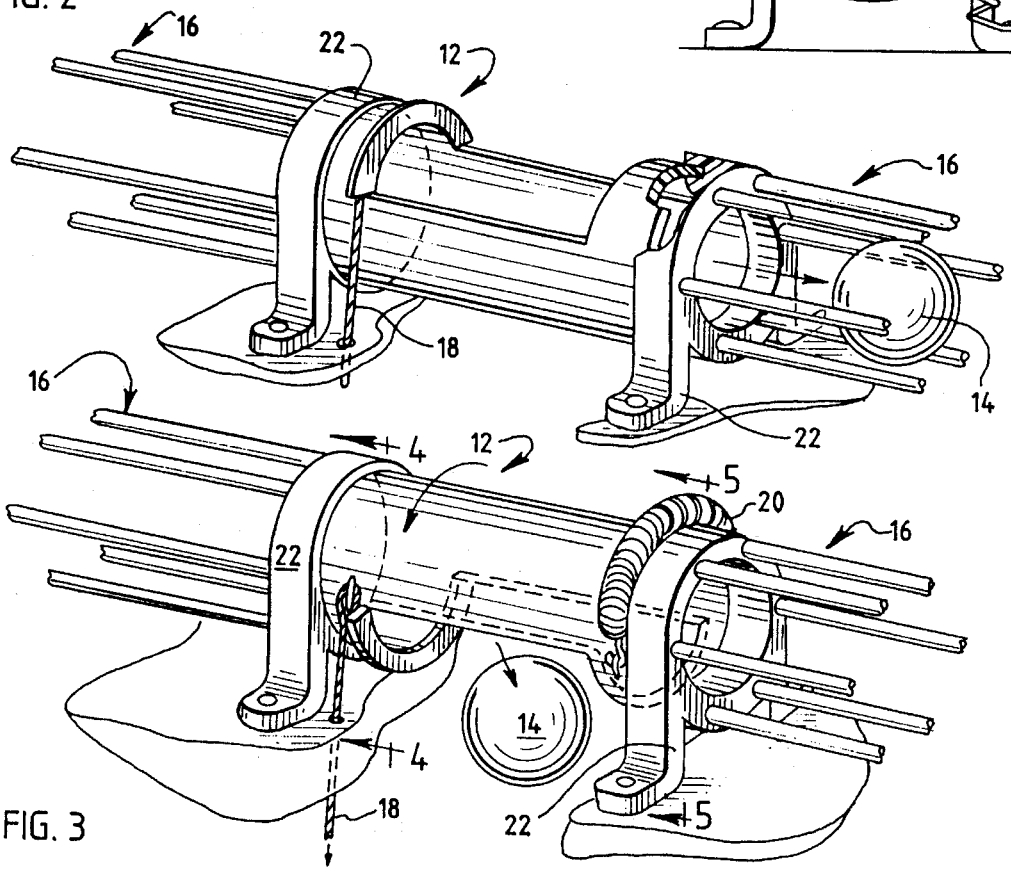
FIG. 3

ROTATING PINBALL BRIDGE AND DROP

FIELD OF THE INVENTION

The present invention concerns a novel rotating pinball bridge and drop.

BACKGROUND OF THE INVENTION

Present day pinball machines typically employ ball ramps for carrying the ball above the surface of the playfield. These ramps can consist of wire, plastic or metal. They most typically are used to return the ball to a flipper from a playfield feature in the upper portion of the playfield. The ramps may be straight, twisted or looped.

The present invention provides a rotating pinball bridge and drop which can be used as part of a pinball ramp. The pinball bridge and drop can be used to either transport the ball along the ramp or drop the ball onto the playfield. In this way, the balls may selectively travel variable distances in the ramp.

It is, therefore, an object of the present invention to provide a rotatable pinball bridge and drop that is easy and inexpensive in construction.

Another object of the present invention is to provide a rotatable pinball bridge and drop that is simple in operation.

Other objects and advantages of the present invention will become apparent as the description proceeds.

SUMMARY OF THE INVENTION

In accordance with the present invention, a rotating pinball bridge and drop is provided which comprises a rotatable cylinder with a hole sufficiently sized to allow a pinball to pass through. The cylinder may be rotated by a drive member so that a ball may either pass therethrough or be dropped from the ramp. In the illustrative embodiment, the drive member comprises a motor and a cable or a solenoid and a cable.

The cylinder may be attached to a tensioning member, such as a return spring, in order to return the cylinder to its resting position.

The rotatable cylinder may be held by two mounting collars at opposite ends thereof. The inner surfaces of the mounting collars comprise a friction reducing surface so that the cylinder will rotate freely. In the illustrative embodiments, the entire collars are made of a friction-reducing material such as nylon or teflon.

A more detail explanation of the invention is provided in the following description and claims and is illustrated in the accompanying drawings.

BRIEF DESCRIPTION OF THE DRAWINGS

FIG. 1 is a perspective view of a pinball machine with a pinball bridge and drop located above the playfield in a wire ramp;

FIG. 2 is a perspective view of a rotating pinball bridge and drop constructed in accordance with the principles of the present invention;

FIG. 3 is a further view of the device of FIG. 2 in which the pinball bridge and drop has been rotated 180°;

FIG. 4 is a cross-sectional view, taken along the plane of the line 4—4 of FIG. 3; and FIG. 5 is a cross-sectional view, taken along the plane of the line 5—5 of FIG. 3.

DETAILED DESCRIPTION OF THE ILLUSTRATIVE EMBODIMENT

Referring to the drawings, a pinball machine (10) of conventional design is shown in FIG. 1. A rotatable bridge and drop (12) is located above the playfield as part of a wire ramp. The rotatable bridge and drop (12) is cylindrically-shaped with a hole or slot of sufficient size to allow a pinball to pass through.

FIG. 2 and FIG. 3 illustrate two operating modes for the rotatable pinball bridge and drop (12). In FIG. 2, the pinball bridge and drop (12) is shown closed such that a pinball (14) is carried through the pinball bridge and drop (12) and along a wire ramp (16). In FIG. 3, the pinball bridge and drop (12) is shown open such that a pinball (14) will be dropped out of the ramp (16).

In the illustrative embodiment shown herein, the pinball bridge and drop (12) is closed in its resting position as shown in FIG. 2. Of course, the pinball bridge and drop (12) could be open at rest.

Apparatus is provided for driving the rotation of the pinball bridge and drop and returning it to its resting position. The pinball bridge and drop (12) is connected by a cable (18) to a motor or solenoid (not shown) below the playing surface. A wire, strap or other device capable of functioning to operatively connect the motor or solenoid to the pinball bridge and drop can be used. The pinball bridge and drop (12) is also connected to a tensioning means, such as the spring (20). The pinball bridge and drop (12) is rotatably mounted in two mounting collars (22) located at opposite ends thereof.

It is contemplated that the pinball bridge and drop (12) will be made of metal or hard plastic. The inside surface of the mounting collars (22) will comprise a friction-reducing material or, as in a preferred embodiment, the entire collars (22) could be made of a friction-reducing material such as nylon or teflon.

In operation, the pinball bridge and drop (12) would be associated with some game feature or theme. Either randomly, after a set period of time or after some set of targets or other game feature has been completed, the motor or solenoid would be activated to pull the cable (18) and rotate the pinball bridge and drop (12) to the position shown in FIG. 3 so that the ball will be dropped out of the ramp. After the motor or solenoid is deactivated, the spring (20) would return the pinball bridge and drop to its resting position. Alternatively, the pinball bridge and ramp (12) could be designed to close upon the completion of some playfield feature.

Although an illustrative embodiment of the invention has been shown and described, it is to be understood that various modifications and substitutions may be made by those skilled in the art without departing from the novel spirit and scope of the present invention.

What is claimed is:

1. A pinball machine comprising:

a playfield;

one or more pinballs;

a pinball ramp disposed above said playfield;

a pinball bridge and drop disposed in said ramp comprising a cylindrically shaped tube with openings at each end and a hole in the wall of said tube said hole being sized and placed so as to alternatively allow a ball to be carried through the length of said tube or to drop through said hole in the wall of said tube; and a drive attached to said tube to rotate said tube about its longitudinal axis.

2. The device of claim 1 wherein said drive comprises a cable and a motor.

3. The device of claim 1 wherein said drive member comprises a cable and a solenoid.

4. The device of claim 1 further comprising a tensioning member.

5. The device of claim 4 wherein said tensioning member comprises a spring.

6. The device the claim 1 further comprising one or more ring-shaped mounting collars.

7. The device of claim 6 wherein the inner surface of said mounting collars comprises a friction reducing surface.

* * * * *